US006319320B1

(12) United States Patent
Méndez-Gallon

(10) Patent No.: US 6,319,320 B1
(45) Date of Patent: Nov. 20, 2001

(54) COATING MACHINE

(75) Inventor: Benjamin Méndez-Gallon, Königsbronn (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/399,880

(22) Filed: Sep. 21, 1999

(30) Foreign Application Priority Data

Sep. 24, 1998 (DE) ..... 198 43 733

(51) Int. Cl.[7] ..... B05C 1/04

(52) U.S. Cl. ..... 118/414; 118/413; 118/119; 118/126; 118/261

(58) Field of Search ..... 118/414, 413, 118/119, 126, 261; 427/359, 361; 162/281; 15/256.5; 101/120

(56) References Cited

U.S. PATENT DOCUMENTS

| | | | | |
|---|---|---|---|---|
| 4,245,582 | * | 1/1981 | Alheid et al. | 118/119 |
| 4,773,351 | | 9/1988 | Sollinger | 118/119 |
| 4,859,507 | * | 8/1989 | Damrau | 118/413 |
| 5,433,781 | * | 7/1995 | Bernert | 118/413 |
| 5,738,726 | * | 4/1998 | Kaipf et al. | 118/126 |
| 6,004,394 | * | 12/1999 | Gottwald | 118/414 |
| 6,106,619 | * | 8/2000 | Eng | 118/414 |

FOREIGN PATENT DOCUMENTS

| | | |
|---|---|---|
| 32 36 991 A1 | 4/1984 | (DE) . |
| 33 11 081 A1 | 9/1984 | (DE) . |

* cited by examiner

*Primary Examiner*—Laura Edwards
(74) *Attorney, Agent, or Firm*—Taylor & Aust, P.C.

(57) ABSTRACT

A coating machine for the application of a coating medium onto a moving surface includes a counter-force generating device which generates a counter force that opposes the force generated by a load device.

8 Claims, 2 Drawing Sheets

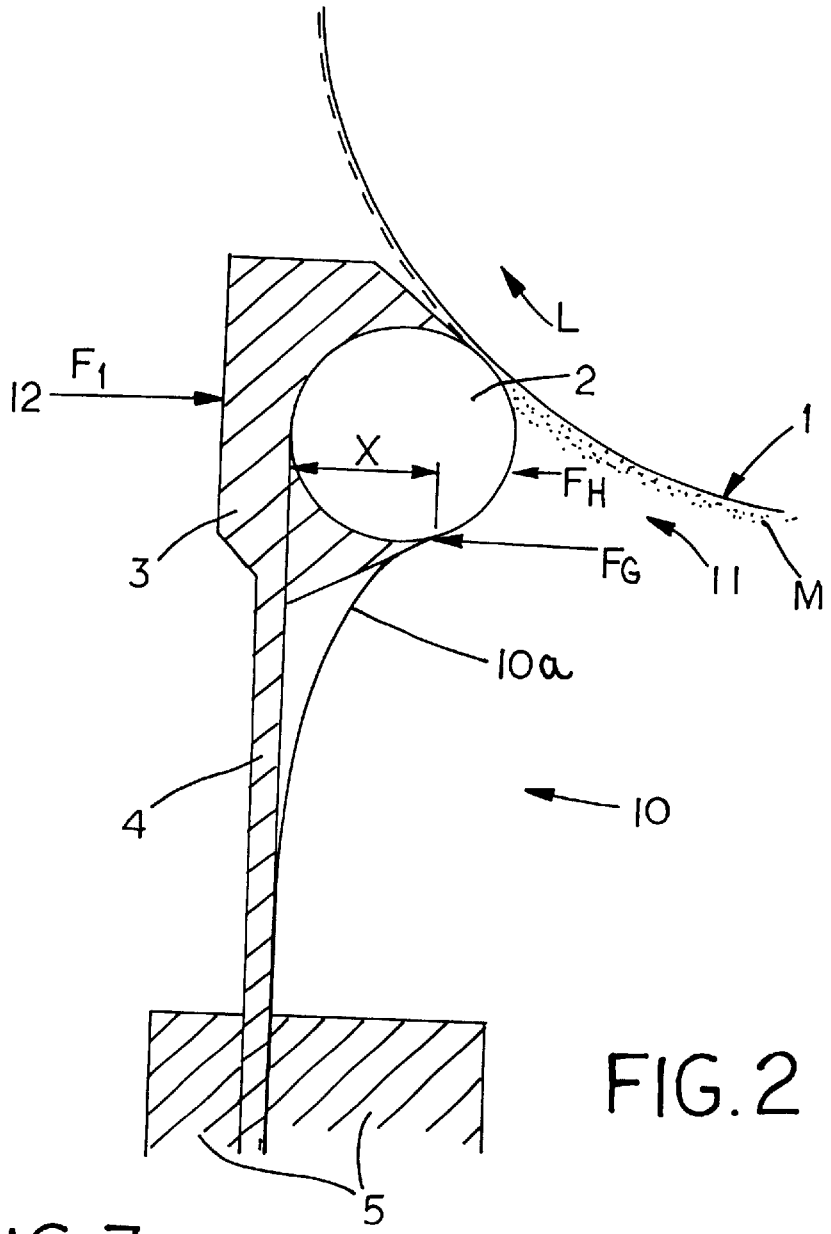
FIG. 2
FIG. 3
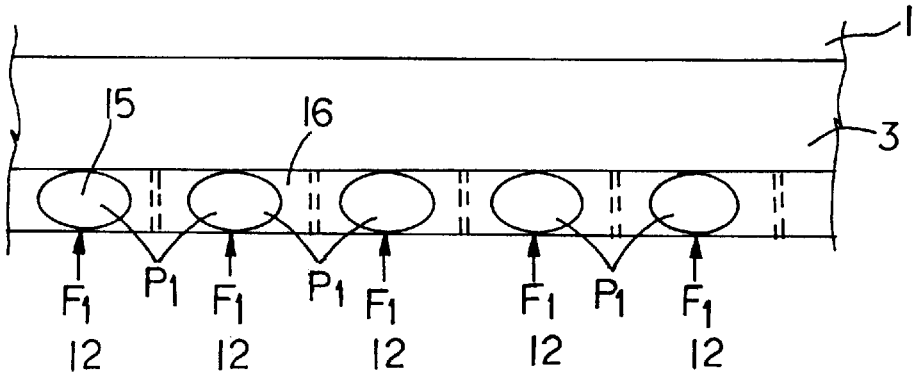

COATING MACHINE

BACKGROUND OF THE INVENTION

1. Field of the Invention

The present invention relates to a coating machine to coat material webs, more particularly, material webs made from paper or carton.

2. Description of the Related Art

Reference is made to German patent document DE 3236991 and DE 33111081. It should be noted here that the moving surface which is to be coated is a material web in the case of direct application. In the case of indirect application, the moving surface is an applicator roll which transfers the medium onto the material web.

The machines described in the above-mentioned patent documents require different coater rods for different mediums to be applied, i.e., different coater rods having various diameters and contact pressure characteristics had to be selected to suit different medium viscosities. This required significant machine time and readjustment of the contact pressure onto the material web each time a new coating medium, and therefore a new coater rod, was selected.

In order to achieve a satisfactory coating quality on the material web, it was necessary to pre-meter the medium in significant excess quantities, which subsequently had to be removed by the coater element in order achieve the required coating weight. As a general rule, approximate 90 to 95% of the pre-metered medium had to be removed from the moving surface. In order to be able to handle the excess coating, it was necessary to maintain a high metering pressure in metering chamber. Therefore, this method required high pumping power (for the supply and discharge of the medium). The removal of excess material was typically performed by groo coater rods which, because of their ability to volumetrically meter the medium, were better for the task. However, these rods are more complex to manufacture and maintain. Furthermore, these particular rods are prone to substantially greater wear compared to smooth coater rods.

SUMMARY OF THE INVENTION

The present invention provides a coating machine which avoids the above-stated disadvantages with a minimum of technical complexity.

The inventor has recognized that the provision of counter force $F_G$ in the metering chamber, which opposes force $F_1$ acting upon the coater rod, can be built up to a level so that the contact force of the coater rod no longer is the only deciding factor in achieving the desired coating weight on the material web.

Force $F_1$ is dependent on the pressure in a pressurized hose, which generates the coater pressure, for example. This force $F_1$ is determined by this formula:

$$F_1=F_H+F_G,$$

whereby, $F_H$ is the hydrodynamic force which forces the coating medium against the coater rod in the metering chamber. The hydrodynamic force is a function of the viscosity of the coating medium, the diameter of the coater rod and the machine speed setting.

The pre-load force $F_1$ and the hydrodynamic force $F_H$ relate to each other in a favorable way. Therefore, the force $F_1$ acting upon the coating element is more finely adjustable than before.

There are several ways to generate the counter force $F_G$. It is possible, for example, to employ a fixed-movable bearing combination. It is especially advantageous to employ a pre-load panel. Such a panel is very simple to procure and manufacture. Depending on the thickness of the pre-load panel, different pre-load forces can be generated, assuming a constant geometry of the coating machine. This allows the use of only one size coater rod regardless of what coating medium is used, which, in turn, requires only a single coater rod bed supporting the coater rod. The diameter of the coater rod is now only 20 mm, for example.

It is preferred for the coater rod of the present invention to have a smooth outer surface. As mentioned above, this coater rod is simple to manufacture and wears substantially less than grooved rods or rods with wires wound around them.

A further feature of the present invention consists of the advantage that it is no longer imperative to maintain the pressure in the metering chamber. The key factor to achieve the required coating weight and a uniform coating of the material web is simply the supply of the required amount of coating medium. The conditions for a so-called "1:1 coating" are therefore established. In other words, it is only necessary to supply the amount of coating medium that is indeed used. The present invention eliminates the need to supply and remove large amounts of excess coating material. This results in substantial savings on equipment, pump power, coating medium, and operational resources.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 2 depicts a derivative design of the coating machine shown in FIG. 1; and FIG. 3 depicts the forced contact of the coater element from FIGS. 1 and 2, as viewed in transverse direction (across the breadth of the machine).

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
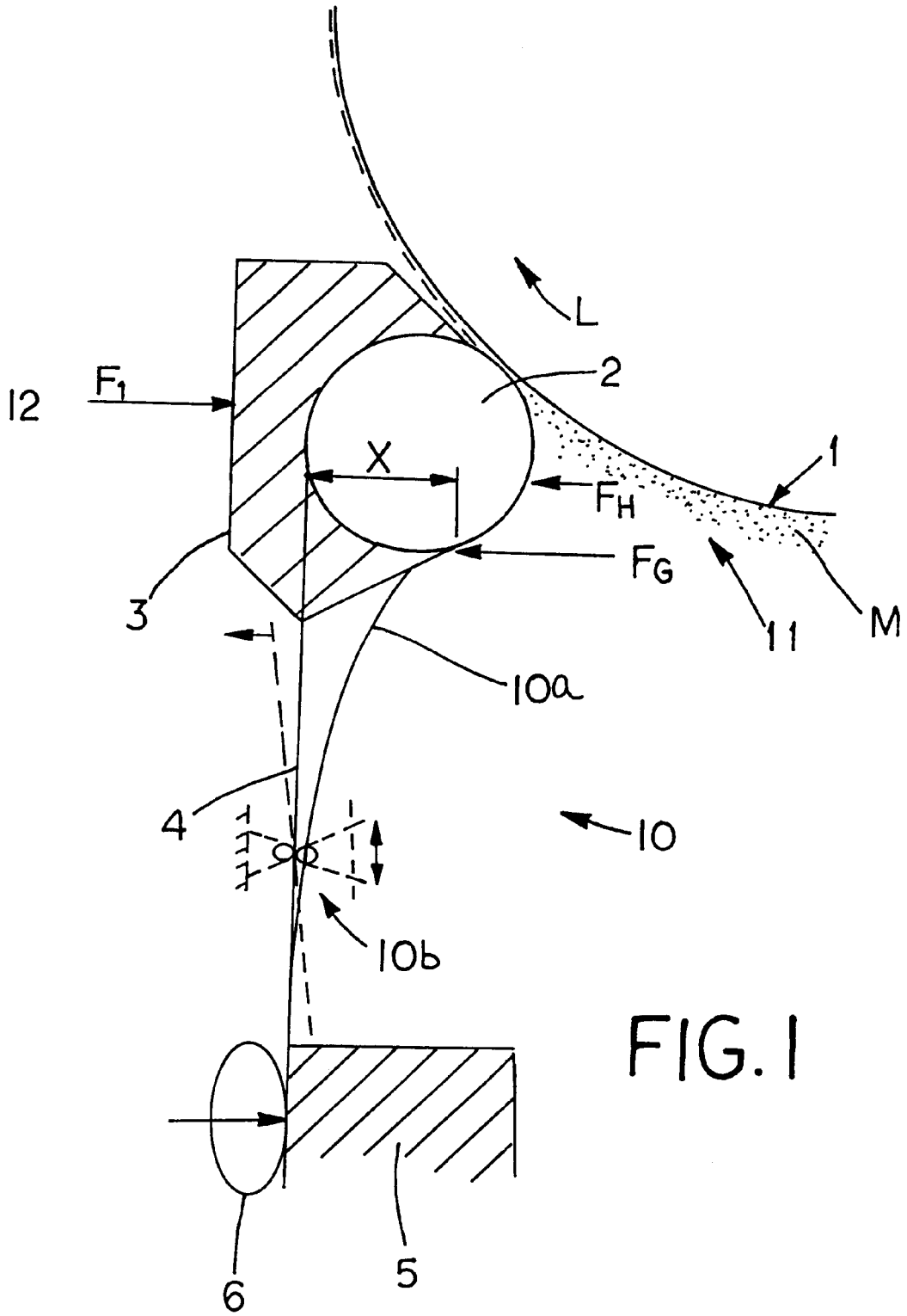
FIG. 1 depicts a schematic cross-section of the coating machine of the present invention.

The components shown in the Figures are designed to match the width of the material web or the width of the machine (which could be as wide as 10 m). Identical components shown in the Figures are labeled using the same reference numbers.

The number 1 labels the moving outer surface or counter surface. This surface can be a material web which is to be coated, or an applicator roll. The feed direction, or direction of movement of the moving surface, is indicated by arrow L. Coater rod or metering 2 rod is positioned against the moving surface 1.

Coater rod 2, which preferably includes a smooth outer surface, is supported by coater rod bed 3. Coater rod bed 3 is, in turn, supported by a thin rail in the shape of a leaf spring type blade 4, as illustrated in FIG. 1. FIG. 2 uses a rail-like footer 14 instead of blade 4 at the coater rod bed 3. Footer 14 can be held in place by pressurized hose 6 (not shown in FIG. 2) or simply by carrier 5. Rail 4 itself is clamped in carrier 5 and held in place by a pressurized hose 6. Also clamped in the carrier 5 is a force-generating device 10 which generates the counter force $F_G$. Force-generating device 10 includes a pre-loaded panel 10*a*, which is preferably made from spring steel. The upper end of force-generating device 10 contacts the coater rod bed 3 below the coater rod 2. The pre-loaded panel 10*a* is more easily exchangeable than a coater rod positioned in the coater rod bed. The panel 10*a* can also be easily cleaned and is exposed to very little, if any, wear.

The panel 10*a*, together with coater rod 2, the coater rod bed 3, the moving surface 1, and the end walls of the metering chamber 11, establish the boundaries within which the medium to be applied (in accordance to the direction of feed arrow shown by in the figure) is transported to coater rod 2.

The distance x between the contact point of the pre-loaded panel 10*a* at the coater rod bed and rail 4 or footer 14 should be no less than the size of the radius of the coater rod 2 in order to achieve sufficient pre-load ($F_G$) (ref FIG. 2). The magnitude of the pre-load is determined by the thickness of the panel. The thickness of panel 10*a* should be no more than 3 mm maximum. As the thickness of panel 10*a* increases, the force $F_G$ opposing the force against the coater rod ($F_1$) also increases, and is therefore suitable for low viscosity applications.

It should be noted here that there are other ways to generate the counter force $F_G$, such as for example, a fixed-movable bearing retention device 10*b* of blade 4 (shown in FIG. 1 in dashed lines). Retention device 10*b* is capable of vertical adjustment as indicated by the double arrow in FIG. 1. This allows the magnitude of the counter force to be controlled. A movement towards the top generates a larger force, a movement towards the bottom generates a smaller force.

In order to force coater rod 2 together with the coater rod bed 3 against the moving surface 1, there is at least one load device 12. Typically, there are a plurality of devices 12 distributed across the width of the machine (ref. FIG. 3), capable of generating different forces $F_1$, countering the pre-load force $F_G$ and the present hydraulic pressure $F_H$ in the metering chamber. Load devices 12 are, for example, pressure hoses extending across the width of the machine with individual, compartmentalized pressure chambers 15, each of which is pressurized by a pressure $p_1$. As indicated in FIG. 3 by a dashed line, separate pressure cushions 16, each of them capable of being pressurized, may also be used. Additionally, adjusting spindle devices or various other actuating devices can be applied.

Thus, it is seen that the present invention facilitates, in an easy and cost effective manner, improved contact conditions at the coater rod, significantly simplified availability of the coater rod, application of coating without or with minimum excess coating material, simplified cleaning and maintenance, ease of operation, and substantial energy savings due to reduced pump power requirements.

It should be further noted that the present invention can be applied to single-sided coating applications, as well as double-sided coating applications.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coating machine for the application of a coating medium onto a moving surface having a direction of travel, the moving surface being one of a fiber material web and an applicator roll, said coating machine comprising:

a coater rod bed;

a coater rod embedded in said coater rod bed;

at least one load device configured for applying a force $F_1$ to said coater rod bed, to thereby bring said coater rod into contact with the moving surface;

a carrier including a rail, said rail supporting said coater rod bed; and a force generating device configured for generating a counter force $F_G$ and for applying said counter force $F_G$ to said coater rod bed in opposition to said force $F_1$ generated by said at least one load device, said force $F_1$ being given by $$F_1=F_H+F_G,$$

wherein $F_H$ is a hydrodynamic force which is applied onto said coater rod by the coating medium.

2. The coating machine of claim 1, further comprising a pre-load panel extending across a width of the coater rod bed, said pre-load panel having a lower end and generating said counter force $F_G$, said pre-load panel being mounted at said lower end in said carrier and contacting said coater rod bed at a point below said coater rod.

3. The coating machine of claim 2, wherein said pre-load panel, said coater rod, said coater rod bed and said moving surface conjunctively define a metering chamber for the coating medium.

4. The coating machine of claim 2, wherein said coater rod has a radius, said pre-load panel contacting said coater rod bed at a point disposed a predetermined distance from said rail, said predetermined distance being approximately equal to said coater rod radius.

5. The coating machine of claim 2, wherein said pre-load panel has a maximum thickness of 3 mm.

6. A coating machine for the application of a coating medium onto a moving surface having a direction of travel, the moving surface being one of a fiber material web and an applicator roll, said coating machine comprising:

a coater rod bed;

a coater rod embedded in said coater rod bed;

at least one load device configured for applying a force F1 to said coater rod bed, to thereby bring said coater rod into contact with the moving surface;

a carrier including a rail, said rail supporting said coater rod bed;

a force generating device configured for generating a counter force $F_G$ and for applying said counter force $F_G$ to said coater rod bed in opposition to said force $F_1$ generated by said at least one load device, said force $F_1$ being given by $$F_1=F_H+F_G,$$

wherein $F_H$ is a hydrodynamic force which is applied onto said coater rod by the coating medium; and a bearing retention device disposed between said carrier and said coater rod bed, said bearing retention device being configured for clamping said rail to thereby generate said counter force $F_G$ said bearing retention device being adjustably positioned on the rail supporting the coater rod bed and fixedly positioned on the rail upon coating of the moving surface.

7. The coating machine of claim 6, wherein said bearing retention device is vertically adjustable.

8. The coating machine of claim 1, wherein said coater rod has a smooth surface.

* * * * *

UNITED STATES PATENT AND TRADEMARK OFFICE

CERTIFICATE OF CORRECTION

PATENT NO. : 6,319,320 B1
DATED : November 20, 2001
INVENTOR(S) : Benjamin Mendez-Gallon It is certified that error appears in the above-identified patent and that said Letters Patent is hereby corrected as shown below:

Column 1,
Line 33, before “metering”, insert -- the --;
Line 36, delete “groo” and substitute -- grooved -- therefor; and
Line 37, after “better”, insert -- suited --.

Column 3,
Line 32, after “as”, insert -- , --.

Signed and Sealed this

Fifteenth Day of April, 2003

JAMES E. ROGAN
*Director of the United States Patent and Trademark Office*